US006372402B1

(12) United States Patent
Pan et al.

(10) Patent No.: US 6,372,402 B1
(45) Date of Patent: Apr. 16, 2002

(54) DEVELOPER COMPOSITIONS AND PROCESSES

(75) Inventors: David H. Pan, Rochester; Christopher M. Knapp, Fairport, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/777,469

(22) Filed: Feb. 6, 2001

(51) Int. Cl.[7] ..... G03G 9/135
(52) U.S. Cl. ..... 430/115; 430/114
(58) Field of Search ..... 430/114, 115, 430/126

(56) References Cited

U.S. PATENT DOCUMENTS

| | | | | | |
|---|---|---|---|---|---|
| 4,707,429 | A | | 11/1987 | Trout | 430/115 |
| 4,822,710 | A | * | 4/1989 | Croucher et al. | 430/126 |
| 5,019,477 | A | | 5/1991 | Felder | 430/115 |
| 5,028,508 | A | | 7/1991 | Lane et al. | 430/115 |
| 5,030,535 | A | | 7/1991 | Drappel et al. | 430/116 |
| 5,034,299 | A | | 7/1991 | Houle et al. | 430/115 |
| 5,045,425 | A | | 9/1991 | Swidler | 430/115 |
| 5,066,821 | A | | 11/1991 | House et al. | 430/137 |
| 5,223,368 | A | | 6/1993 | Ciccarelli et al. | 430/110 |
| 5,306,591 | A | | 4/1994 | Larson et al. | 430/115 |
| 5,308,731 | A | | 5/1994 | Larson et al. | 430/115 |
| 5,366,840 | A | | 11/1994 | Larson et al. | 430/115 |
| 5,567,564 | A | * | 10/1996 | Ziolo | 430/115 |
| 5,627,002 | A | | 5/1997 | Pan et al. | 430/115 |
| 5,826,147 | A | | 10/1998 | Liu et al. | 399/237 |

* cited by examiner

*Primary Examiner*—John Goodrow
(74) *Attorney, Agent, or Firm*—E. O. Palazzo

(57) ABSTRACT

A liquid developer contains, for example, a nonpolar liquid, thermoplastic resin, optional colorant, and an inorganic filler

27 Claims, No Drawings

DEVELOPER COMPOSITIONS AND PROCESSES

COPENDING APPLICATIONS AND PATENTS

In copending application U.S. Ser. No. 09/777,423, pending filed concurrently herewith, the disclosure of which is totally incorporated herein by reference, there is illustrated A liquid developer comprised of a nonpolar liquid, thermoplastic resin, colorant, and a silica charge acceptance additive; U.S. Ser. No. 09/777,967, allowed filed concurrently herewith, the disclosure of which is totally incorporated herein by reference, illustrates a liquid developer comprised of a nonpolar liquid, thermoplastic resin, colorant, and a was charge acceptance additive; U.S. Ser. No. 09/777,598, allowed filed concurrently herewith, the disclosure of which is totally incorporated herein by reference, illustrates a liquid developer comprised of a nonpolar liquid, thermoplastic resin, optional colorant, and an alumina charge acceptance additive; U.S. Ser. No. 09/777,605, allowed filed concurrently herewith, the disclosure of which is totally incorporated herein by reference, illustrates a liquid developer comprised of a nonpolar liquid, resin, optional colorant, and an alkaline earth charge acceptance additive; U.S. Ser. No. 09/777,301, pending filed concurrently herewith, the disclosure of which is totally incorporated herein by reference, illustrates an imaging apparatus comprising a support member including a support surface for supporting a layer of marking material; a marking material supply apparatus for depositing marking material on the surface of said support member to form a layer of marking material thereon; a charging source for selectively delivering charge species to the layer of marking material in an imagewise manner to form an electrostatic latent image in the layer of marking material, wherein the electrostatic latent image includes image areas of a first charge voltage and nonimage areas of a second charge voltage distinguishable from the first charge voltage; and a separator member for selectively separating portions of the marking material layer in accordance with the latent image in the marking material layer to create a developed image and wherein said marking material is comprised of a liquid developer comprised of a nonpolar liquid, resin, colorant, and a charge acceptance component comprised of a cyclodextrin; and U.S. Ser. No. 09/777,968, pending filed concurrently herewith, the disclosure of which is totally incorporated herein by reference, illustrates an imaging apparatus comprising a support member including a support surface for supporting a layer of marking material; a marking material supply apparatus for depositing marking material on the surface of said support member to form a layer of marking material thereon; a charging source for selectively delivering charge species to the layer of marking material in an imagewise manner to form an electrostatic latent image in the layer of marking material, wherein the electrostatic latent image includes image areas with a first charge voltage and nonimage areas with a second charge voltage distinguishable from the first charge voltage; and a separator member for selectively separating portions of the marking material layer in accordance with the latent image in the marking material layer to create a developed image and wherein said marking material is comprised of a liquid developer comprised of a nonpolar liquid, resin, colorant, and a charge acceptance component comprised of an aluminum complex.

Illustrated in U.S. Pat. Nos. 6,180,308 and 6,218,066, the disclosures of each application being totally incorporated herein by reference, are developers with charge acceptance components and imaging processes thereof.

Illustrated in U.S. Pat. No. 5,627,002, the distance of which is totally incorporated herein by reference, is a positively charged liquid developer comprised of a nonpolar liquid, thermoplastic resin particles, pigment, a charge director, and a charge control agent comprised of a cyclodextrin or a cyclodextrin derivative containing one or more organic basic amino groups. In U.S. Pat. No. 5,366,840, the disclosure of which is totally incorporated herein by reference, there are illustrated developers with aluminum complex components and which components may be selected as a charge acceptance additive for the developers of the present invention.

Disclosed in U.S. Pat. No. 5,826,147, the disclosure of which is totally incorporated herein by reference, is an electrostatic latent image development process wherein there is selected an imaging member with an imaging surface containing a layer of marking material and wherein imagewise charging can be accomplished with a wide beam ion source such that free mobile ions are introduced in the vicinity of an electrostatic image associated with the imaging member.

The appropriate components and processes of the above copending applications and patents may be selected for the present invention in embodiments thereof.

BACKGROUND OF THE INVENTION

This invention is generally directed to liquid developer compositions and processes thereof, and wherein there can be generated improved developed images thereof in bipolar ion charging processes, and reverse charge imaging and printing development (RCP) processes, reference U.S. Pat. No. 5,826,147, the disclosure of which is totally incorporated herein by reference, and wherein the developer contains no charge director, or wherein the developer contains substantially no charge director. The liquid developer of the present invention can be clear in color when comprised of a resin, a hydrocarbon liquid carrier, and as a charge acceptor a filler component with a high dielectric constant, wherein high possesses values of, for example, from about 4 to about 1,000, and more specifically, wherein the charge acceptor component is comprised of an inorganic fillers, such as silicates, kaolins, silicate layers, silicate sheets, micas, zeolites, and the like, especially for example calcium silicates, nanosize kaolins, mica, disks, zeolites with nanosize cavities, wherein nanosize is, for example, from about 0.1 to about 2 nanometers in diameter.

The present invention is also specifically directed to an electrostatographic imaging process wherein an electrostatic latent image bearing member containing a layer of marking material, toner particles, or liquid developer as illustrated herein and containing a charge acceptance additive, which additive may be coated on the developer, is selectively charged in an imagewise manner to create a secondary latent image corresponding to the electrostatic latent image on the imaging member. Imagewise charging can be accomplished by a wide beam charge source for introducing free mobile charges or ions in the vicinity of the electrostatic latent image coated with the layer of marking material or toner particles. The latent image causes the free mobile charges or ions to flow in an imagewise ion stream corresponding to the latent image. These charges or ions, in turn, are accepted by the marking material or toner particles, leading to imagewise charging of the marking material or toner particles with the layer of marking material or toner particles itself becoming the latent image carrier. The latent image carrying toner layer is subsequently developed by selectively separating and transferring image areas of the toner layer to a copy substrate for producing an output document.

The present invention further relates to an imaging apparatus, wherein an electrostatic latent image including image and nonimage areas is formed in a layer of marking material, and further wherein the latent image can be developed by selectively separating portions of the latent image bearing layer of the marking material such that the image areas reside on a first surface and the nonimage areas reside on a second surface. In embodiments, the image development apparatus comprises a system for generating a first electrostatic latent image on an imaging member, wherein the electrostatic latent image includes image and nonimage areas having distinguishable charge potentials, and a system for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image.

The liquid developers and processes of the present invention possess a number of advantages in embodiments including the development and generation of images with excellent image quality, the avoidance of a charge director, the use of the developers in a reverse charging development process, excellent, for example about 90 to about 98 percent, image transfer, and the avoidance of complex chemical charging of the developer. Poor transfer can, for example, result in poor solid area coverage if insufficient toner is transferred to the substrate and can also cause image defects such as smears and hollowed fine features. Conversely, overcharging the toner particles can result in low reflective optical density images, poor color richness or chroma since only a few very highly charged particles can discharge all the charge on the dielectric receptor causing too little toner to be deposited. To overcome or minimize such problems, the liquid toners, or developers and processes of the present invention were developed. Other advantages are as illustrated herein and also include minimal or no image blooming, the generation of excellent solid area images, minimal or no developed image character defects, the enablement of clear, or colorless liquid developers, and the like.

PRIOR ART

A latent electrostatic image can be developed with toner particles dispersed in an insulating nonpolar liquid. These dispersed materials are known as liquid toners or liquid developers. The latent electrostatic image may be generated by providing a photoconductive imaging member or layer with a uniform electrostatic charge, and developing the image with a liquid developer, or colored toner particles dispersed in a nonpolar liquid which generally has a high volume resistivity in excess of $10^9$ ohm-centimeters, a low dielectric constant, for example below about 3, and a moderate vapor pressure. Generally, the toner particles are less than about 30 $\mu$m (microns) average by area size as measured with the Malvem 3600E particle sizer.

U.S. Pat. No. 5,019,477, the disclosure of which is totally incorporated herein by reference, discloses a liquid electrostatic developer comprising a nonpolar liquid, thermoplastic resin particles, and a charge director. The ionic or zwitterionic charge directors illustrated may include both negative charge directors, such as lecithin, oil-soluble petroleum sulfonates and alkyl succinimide, and positive charge directors such as cobalt and iron naphthanates. The thermoplastic resin particles can comprise a mixture of (1) a polyethylene homopolymer or a copolymer of (i) polyethylene and (ii) acrylic acid, methacrylic acid or alkyl esters thereof, wherein (ii) comprises 0.1 to 20 weight percent of the copolymer; and (2) a random copolymer (iii) of vinyl toluene and styrene and (iv) butadiene and acrylate.

U.S. Pat. No. 5,030,535, the disclosure of which is totally incorporated herein by reference, discloses a liquid developer composition comprising a liquid vehicle, a charge additive and toner particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture, and then cooling the mixture whereby the polymer becomes insoluble in the liquid vehicle, thus forming an insoluble resin layer around the pigment particles.

Moreover, in U.S. Pat. No. 4,707,429, the disclosure of which is totally incorporated herein by reference, there are illustrated, for example, liquid developers with an aluminum stearate charge adjuvant. Liquid developers with charge directors are also illustrated in U.S. Pat. No. 5,045,425. Further, of interest with respect to liquid developers are U.S. Pat. Nos. 5,034,299; 5,066,821 and 5,028,508, the disclosures of which are totally incorporated herein by reference.

Illustrated in U.S. Pat. No. 5,306,591, the disclosure of which is totally incorporated herein by reference, is a liquid developer comprised of a liquid component, thermoplastic resin; an ionic or zwitterionic charge director, or directors soluble in a nonpolar liquid; and a charge additive, or charge adjuvant comprised of an imine bisquinone; in U.S. Statutory Invention Registration No. H1483 there is described a liquid developer comprised of thermoplastic resin particles, and a charge director comprised of an ammonium AB diblock copolymer, and in U.S. Pat. No. 5,307,731 there is disclosed a liquid developer comprised of a liquid, thermoplastic resin particles, a nonpolar liquid soluble charge director, and a charge adjuvant comprised of a metal hydroxycarboxylic acid, the disclosures of each of these patents, and the Statutory Registration being totally incorporated herein by reference.

SUMMARY OF THE INVENTION

Examples of features of the present invention include:

It is a feature of the present invention to provide a liquid developer with many of the advantages illustrated herein, such as substantial increases in bipolar charging levels, compared to the same or similar liquid developer without filler, such as an alkaline earth containing charge acceptance additive, improved charging levels, as measured by using the surface voltage after ion charging, increases in bipolar charging levels, and an increase in toner charge QIM, reference copending application U.S. Ser. No. 09/777,967, the disclosure of which is totally incorporated herein by reference.

Another feature of the present invention resides in the provision of a liquid developer, especially a clear colored developer with no colorant, capable of modulated particle charging with, for example, corona ions for image quality optimization.

It is a further feature of the invention to provide positively charged, and/or negatively charged liquid developers, including colorless or clear in color, wherein there are selected as charge acceptance agents or charge acceptance additives inorganic fillers, such as silicates, kaolins, silicate layers, silica sheets, micas, zeolites, and the like.

It is still a further feature of the invention to provide positively, and negatively charged liquid developers wherein developed image defects, such as smearing, loss of resolution and loss of density, and color shifts in the developed prints having magenta images overlaid with yellow images are eliminated or minimized, and wherein the charge level of negative and positive polarities are balanced or substantially equal.

Also, in another feature of the present invention there are provided positively charged liquid developers with certain charge acceptance agents that are in embodiments superior to liquid developers with no charge director in that they can be selected for RCP development, reference U.S. Pat. No. 5,826,147, the disclosure of which is totally incorporated herein by reference, and wherein there can be generated high quality images.

Furthermore, in another feature of the present invention there are provided liquid toners that enable excellent image characteristics, and which toners enhance the positive charge of the resin selected, such as ELVAX®, based resins.

These and other features of the present invention can be accomplished in embodiments by the provision of liquid developers.

Aspects of the present invention relate to a liquid developer comprised of a nonpolar liquid, thermoplastic resin, optional colorant, and an inorganic filler; a developer wherein there is included therein an inorganic filler of a silicate, kaolin, a silicate layer, a silica sheet, mica, a zeolite, or mixtures thereof, and which filler functions as a charge acceptance additive; a developer containing a filler is selected from the group consisting of silicates, kaolins, silicate layers, silica sheets, micas and zeolites; a developer wherein the filler is a silicate of formula $M_3^{II}M_2^{III}(SiO_4)$, where $M^{II}$ is $Ca^{+2}$, $Mg^{+2}$, or $Fe^{+2}$, and $M^{III}$ is $Al^{+3}$, $Cr^{+3}$, or $Fe^{+3}$; silicates containing the disilicate anion $Si_2O_7^{-6}$: $Sc_2Si_2O_7$ or $Zn_4(OH)_2\ Si_2O_7$; silicates containing infinite chains of the formula $MgSiO_3$, $CaSiO_3$ or $CaMg(SiO_3)_2$; or silicates containing layer or sheet-like structures with an empirical formula $(Si_2O_5)_n^{-2n}$; kaolin, $Al_2(OH)_4Si_2O_5$; talc, $Mg_3(OH)_2(Si_2O_5)_2$; micas, or $K(Mg,Fe)_3(AlSi_3O_{10})$; a liquid developer wherein the inorganic filler possesses a particle size of from about 1 nanometer to about 100 nanometers; a developer wherein the colorant is present in an amount of from about 1 to about 60 percent by weight based on the total weight of the developer solids; a developer wherein the colorant is carbon black, cyan, magenta, yellow, blue, green, orange, red, violet and brown, or mixtures thereof; a developer wherein the filler functions primarily as a charge acceptance additive, and which additive is present in an amount of from about 0.05 to about 10 weight percent based on the weight of the developer solids of resin, colorant, and filler; a developer wherein the inorganic filler is a zeolite of the formula $M_{x/n}^{+n}[Al_xSi_yO_{2x+2y}]^{-x}\ zH_2O$ wherein x and n represent the valences of the respective species, M is a metal, and z represents the number of water molecules; a developer wherein the inorganic filler functions as a charge acceptance component and possesses a high dielectric constant of from about 3.5 to about 1,000; a developer wherein the liquid for the developer is an aliphatic hydrocarbon; a developer wherein the aliphatic hydrocarbon is a mixture of branched hydrocarbons of from about 8 to about 16 carbon atoms, or a mixture of normal hydrocarbons of from about 8 to about 16 carbon atoms; a developer wherein the resin is an alkylene polymer, a styrene polymer, an acrylate polymer, a polyester, mixtures thereof or copolymers thereof; a developer wherein the resin is poly(ethylene-co-vinylacetate), poly(ethylene-co-methacrylic acid), poly (ethylene-co-acrylic acid), or poly(propoxylated bisphenol) fumarate; a developer wherein the resin is selected from the group consisting of alpha-olefin/vinyl alkanoate copolymers, alpha-olefin/acrylic acid copolymers, alpha-olefin/methacrylic acid copolymers, alpha-olefin/acrylate ester copolymers, alpha-olefin/methacrylate ester copolymers, copolymers of styrene/n-butyl acrylate or methacrylate/acrylic or methacrylic acid, and unsaturated ethoxylated and propoxylated bisphenol A polyesters; a developer further containing a charge additive comprised of a mixture of I. a nonpolar liquid soluble organic aluminum complex that has been rendered insoluble by chemical bonding to the toner resin or by adsorption to the toner particles, II. a nonpolar liquid soluble organic phosphate mono and diester mixture derived from phosphoric acid and isotridecyl alcohol that has been rendered insoluble by bonding to the insoluble organic aluminum complex and, or mixtures thereof of the formulas

I

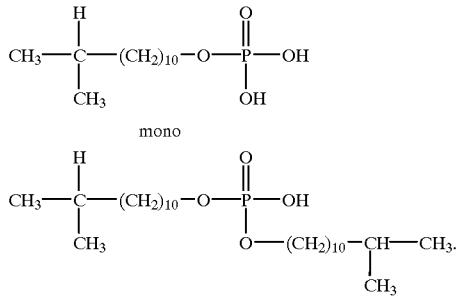

II

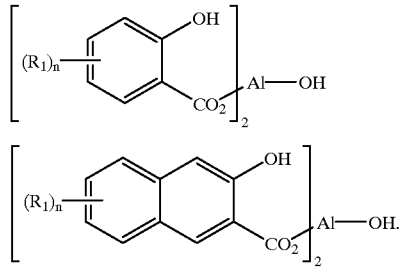

wherein $R_1$ is selected from the group consisting of hydrogen and alkyl, and n represents a number; a developer wherein the developer further includes a charge adjuvant; a positively, or negatively charged substantially clear liquid developer comprised of a nonpolar liquid, resin, and a charge acceptance agent comprised of an inorganic filler; a colorless developer containing an inorganic filler of a silicate, kaolin, a silicate layer, a silica sheet, mica, a zeolite, or mixtures thereof, and which filler functions as a charge acceptance additive; a colorless developer wherein the inorganic filler is a zeolite; a developer which possesses a surface charging voltage of from about 75 volts to about 250 volts in both positive and negative polarities, and which surface charging voltage after ion charging is measured by an electrostatic voltmeter; a developer further containing a colorant; a developer comprised of from about 1 to about 20 percent solids of from about 1 to about 60 weight percent colorant, from about 0.05 to about 10 weight percent charge acceptance additive, and from about 30 to about 99.95 weight percent resin, and wherein the developer also contains from about 80 to about 99 weight percent of a nonpolar liquid, or a developer comprised of from about 5 to about 15 percent by weight of toner solids comprised of from about 15 to about 55 weight of colorant, from about 0.05 to about 7 percent by weight of charge acceptance additive, and from about 38 to about 85 percent by weight of resin, and wherein the developer further contains from about 85 to about 95 percent by weight of a nonpolar liquid; a developer comprised of a liquid, thermoplastic resin, colorant, and an inorganic filler; a liquid developer wherein the liquid is a nonpolar liquid, and the filler is a zeolite; a printing process wherein the liquid developer illustrated herein is selected; a liquid developer wherein the liquid has a viscosity of from about 0.5 to about 500 centipoise and resistivity equal to or greater than about $5\times10^9$ and the resin is a thermoplastic resin with a volume average particle diameter of from about 0.1 to about 30 microns, and the colorant is present in an amount of from zero (0) to about 40 weight percent; a liquid developer wherein the filler is a mica of the formula $K(Mg,Fe)_3(AlSi_3O_{10})$; a liquid developer wherein the filler is a kaolin of the formula $Al_2(OH)_4Si_2O_5$ or a silicate in the form of a layer with a thickness of from about 0.5 nanometer to about 100 nanometers, or a disk of silicate, and wherein the silicate possesses a thickness of from about 0.5 nanometer to about 100 nanometers with a diameter of the disk being from about 1 nanometer to about 100 nanometers; a liquid developer wherein the filler is calcium silicate, $CaSiO_3$, $MgSiO_3$, $CaMg(SiO_3)_2$, $Ca_2Mg_5(OH)_2(Si_4O_{11})_2$, or $Ca_3Al_2(SiO_3)_3$; a xerographic imaging apparatus comprising a charging component, an imaging member, a developer component, and a fusing component, and wherein the developer component contains the liquid developer illustrated herein; and liquid developers comprised of a nonpolar liquid, resin, preferably a thermoplastic resin, and as a charge acceptor an inorganic filler, such as simple silicates, chain-like silicates, layer or sheet-like silicates, kaolins, micas; aluminosilicates such as zeolites, and the like, especially silicates containing simple silicate anions $SiO_4^{-4}$ of, for example, the general formula $M_3^{II}M_2^{III}(SiO_4)$, where $M^{II}$ can be $Ca^{+2}$, $Mg^{+2}$, or $Fe^{+2}$, and $M^{III}$ is $Al^{+3}$, $Cr^{+3}$, or $Fe^{+3}$; silicates containing the disilicate anion $Si_2O_7^{-6}$ like $Sc_2Si_2O_7$ and $Zn_4(OH)_2Si_2O_7$; silicates containing infinite chains of the formula $(SiO_3)_n^{-2n}$ like $Mg\ SiO_3$, $Ca\ SiO_3$ and $CaMg(SiO_3)_2$; silicates containing layer or sheet-like structures of the empirical formula $(Si_2O_5)_n^{-2}$ like kaolin, $Al_2(OH)_4Si_2O_5$; talc, $Mg_3(OH)_2(Si_2O_5)_2$; micas, or $K(Mg,Fe)_3(AlSi_3O_{10})$. The zeolites can be considered aluminosilicate of the formula $M_{x/n}^{+n}[Al_xSi_yO_{2x+2y}]^{-x}\ zH_2O$, wherein M is an alkaline earth, x and n represent valences, and z represents the number of waters.

In embodiments thereof of the present invention, the liquid developers can be charged in a device which first charges the developer to a first polarity, such as a positive polarity, followed by a second charging with a second charging device to reverse the developer charge polarity, such as to a negative polarity in an imagewise manner. Subsequently, a biased image bearer (IB) separates the image from the background corresponding to the charged image pattern in the toner, or developer layer. Thus, the liquid developers are preferably charged by bipolar ion charging (BIC) rather than with chemical charging.

The charge capturing inorganic fillers, such as silicates like silicates, chain-like silicates, layer or sheet-like silicates, kaolins, micas; aluminosilicates, such as zeolites, and the like, capture ions. Although not being desired to be limited by theory, it is believed that simple silicates, chain-like silicates, layer or sheet-like silicates, kaolins, micas; aluminosilicates, such as zeolites, and the like, have positive metal ions such as Ca, Ba, Al, Fe or K. These metal ion sites capture negative ions from the corona effluent by forming covalent or coordinate covalent (dative) bonds with these negative ions. The metal ion site then becomes negatively charged, and therefore, the charge acceptor particles dispersed in the toner particles become negatively charged. Since this negatively charged charge acceptor particle resides in the immobile toner particle and not in the mobile phase or liquid carrier, the immobile toner layer itself on the dielectric surface becomes negatively charged in an imagewise manner dependent upon the charge acceptor concentration. Since the charge acceptor concentration can be the same throughout the toner layer, it is the amount of toner at a given location in the toner layer that governs the amount of charge acceptor and charge at that location. The amount of charge at a given location then results in differential development (due to different potentials) in accordance with the imagewise pattern deposited on the dielectric surface.

The negative oxide ions in the silicate particles capture positive ions from the corona effluent by forming covalent or coordinate covalent (dative) bonds with these positive ions. The silicate particle then becomes positively charged and therefore the silicate charge acceptor itself becomes positively charged. Since this positively charged particle resides in the immobile toner particle and not in the mobile phase or liquid carrier, the immobile toner layer itself on the dielectric surface becomes positively charged in an imagewise manner dependent upon the charge acceptor concentration. Since the charge acceptor concentration can be the same throughout the toner layer, it is the amount of toner at a given location in the toner layer that governs the amount of charge acceptor and charge at that location. The amount of charge at a given location then results in differential development (due to different potentials) in accordance with the imagewise pattern deposited on the dielectric surface.

There exists another possible mechanism, where corona ion fragments (either polarity) or species derived therefrom that are small enough can become physically entrapped inside a zeolite cavity opening resulting in a charged zeolite particle and hence again a charged toner layer. This ion trapping mechanism is specific to the steric size of the ion emanating from the corona effluent or from species derived therefrom. Ions should be able to fit into the cavity opening to be entrapped so ions too large cannot enter the cavity opening, will not be entrapped and will not charge the toner layer by this mechanism. Ions that are too small to rapidly pass into and out of the zeolite cavity opening and are not entrapped for a significant time period will not charge the toner layer by the aforementioned entrapment mechanism. These inappropriately sized ions, however, could ultimately charge the toner layer by the other described charging mechanisms. It may be possible that some of the corona effluent ions have first interacted with other toner layer components to produce secondary ions wherein these secondary ions then become captured by the silicate charge acceptance particles by one of the many possible mechanisms explained hereinbefore. However, any secondary ion formation that might occur cannot be too extensive since we do not observe a degradation of the polymeric toner resin or the colorant during the toner layer charging steps of this invention. The toner layer retains its integrity and the colorant its color strength.

While not being desired to be limited by theory, although similar to the function of charge control agents in chemically charged liquid developers in that charge acceptance agents in ion-charged liquid developers are directly involved in charging liquid developers, capturing charge using a charge acceptance agent versus a charge control agent is different mechanistically. A first difference resides in the origin and location of the species reacting with a charge acceptance agent versus the origin and location of the species reacting with a charge control agent. The species reacting with a charge acceptance agent originate in the corona effluent, which after impinging on the toner layer become trapped in the solid phase thereof. The species reacting with a charge control agent, for example, the charge director originates by purposeful formulation of the charge director into the liquid developer and remains soluble in the liquid phase of a toner layer. Both the charge acceptance agent (in BIC-RCP developers) and the charge control additive or agent (in chemically charged developers) are insoluble in the liquid developer medium and reside on and in the toner particles, but charge directors, used only in chemically charged developers, dissolve in the developer medium. A second difference between a charge acceptance agent and a charge control agent is that charge directors in chemically charged liquid developers charge toner particles to the desired polarity, while at the same time capturing the charge of opposite polarity so that charge neutrality is always maintained during this chemical equilibrium process. Charge separation occurs only later when the developer is placed in an electric field during development. In the BIC-RCP development process, the corona effluent used to charge the liquid developer is generated from any corona generating device and the dominant polarity of the effluent is fixed by the device. Corona ions first reach the surface of the toner layer, move through the liquid phase, and are adsorbed onto the particle and captured by the charge acceptance agent. The mobile or free corona ions in the liquid phase rapidly migrate to the ground plane. Some of these mobile ions may include counterions, if counterions are formed in the charging process. Counterions bear the opposite polarity charge versus the charged toner particles in the developer. The corona ions captured by the charge acceptance agent in or on the toner charge the developer to the same polarity as the dominant polarity charge in the corona effluent. The ion-charged liquid developer particles remain charged and most counterions, if formed in the process, exit to the ground plane so fewer counter charges remain in the developer layer. Electrical neutrality or equilibrium is not attained in the BIC-RCP development process and development is not interfered with by species containing counter charges. The charge acceptance agent initially resides in the liquid phase, but prior to charging the toner layer the charge acceptance agent deposits on the toner particle surfaces. The concentration of charge acceptor in the nonpolar solvent is believed to be close to the charge acceptor insolubility limit at ambient temperature especially in the presence of toner particles. The adsorption affinity between soluble charge acceptor and insoluble toner particles is believed to accelerate charge acceptor adsorption such that charge acceptor insolubility occurs at a lower charge acceptor concentration versus if toner particles were not present. When the insoluble or slightly soluble charge acceptors accept (chemically bind) ions from the impinging corona effluent (BIC) or from species derived therefrom, there is obtained a net charge on the toner particles in the liquid developer. Since the toner layer contains charge acceptors capable of capturing both positive and negative ions, the net charge on the toner layer is not determined by the charge acceptor but instead is determined by the predominant ion polarity emanating from the corona. Corona effluents rich in positive ions give rise to charge acceptor capture of more positive ions, and therefore, provide a net positive charge to the toner layer. Corona effluents rich in negative ions give rise to charge acceptor capture of more negative ions, and therefore, provide a net negative charge to the toner layer.

The primary difference in the charging mechanism of a charge acceptance agent versus a charge control agent as illustrated herein is that after charging a liquid developer via the standard charge director (chemical charging) mechanism, the developer contains an equal number of charges of both polarity. An equal number of charges of both polarities in the developer hinders reverse charge imaging, thus adding a charge director to the developer before depositing the uncharged developer onto the dielectric surface is undesirable. However, if corona ions in the absence of a charge director are used to charge the toner layer, the dominant ion polarity in the effluent will be accepted by the toner particles to a greater extent resulting in a net toner charge of the desired polarity and little if any counter-charged particles. When the toner layer on the dielectric receiver has more of one kind (positive or negative) of charge on it, reverse charge imaging is facilitated.

Examples of charge acceptance additives present in various effective amounts of, for example, from about 0.001 to about 10, and preferably from about 0.01 to about 7 weight percent or parts, include inorganic fillers, such as silicates, kaolins, silicate layers, silica sheets, micas; zeolites; silicates containing simple silicate anions $SiO_4^{-4}$ of the general formula of $M_3^{II}M_2^{III}(SiO_4)$, where M" can be $Ca^{+2}$, $Mg^{+2}$, or $Fe^{+2}$, and $M^{III}$ is a metal like $Al^{+3}$, $Cr^{+3}$, or $Fe^{+3}$; silicates containing disilicate anions $Si_2O_7^{-6}$ like $Sc_2Si_2O_7$ and $Zn_4(OH)_2Si_2O_7$; silicates containing infinite chains of the formula $(SiO_3)_n^{-2n}$ like $MgSiO_3$, $CaSiO_3$ and $CaMg(SiO_3)_2$; silicates containing layer or sheet-like structures of the formula $(Si_2O_5)_n^{-2n}$ like kaolin, $Al_2(OH)_4Si_2O_5$; talc, $Mg_3(OH)_2(Si_2O_5)_2$; micas, $K(Mg,Fe)_3(AlSi_3O_{10})$, and the like.

Of importance with respect to the present invention is the presence in the liquid developer of the charge acceptor which primarily functions to, for example, increase the Q/M of both positive and negatively charged developers by increasing the surface voltage of the charged toner layer. The captured charge, Q=fCV where C is the capacitance of the toner layer, V is the measured surface voltage, and f is a proportionality constant which is dependent upon the distribution of captured charge in the toner layer. M in Q/M is the total mass of the toner solids and wherein it is believed that all charges are associated with toner particles. The Q/M value of the liquid developer, for example a silicate charge acceptor after ion charging, is increased by about 5 to about 10 folds in comparison to the developer without charge acceptor.

In embodiments of the present invention, the charge acceptance agents are selected in various effective amounts, such as for example from about 0.01 to about 10, and more specifically, from about 1 to about 7 weight percent based on the total weight percent of the resin solids, other charge additives, colorant, such as pigments when present, and inorganic fillers, and wherein the total of all solids is, for example, from about 1 to about 20 percent and the total amount of the nonpolar liquid is about 80 to about 99 percent based on the weight of the liquid developer. The toner solids can, for example, contain about 1 to about 7 weight percent of an inorganic filler, preferably of a nanoparticle size, about 15 to about 60 weight percent of colorant, and about 33 to about 83 weight percent of resin. The developer may be clear in color, or substantially clear in color when it contains no colorant, and which developer possesses high bipolar charging voltage values, such as for example from about 75 volts to about 250 volts and preferably from about 150 volts to about 250 volts.

Examples of nonpolar liquid carriers or components selected for the developers of the present invention include a liquid with an effective viscosity of, for example, from about 0.5 to about 500 centipoise, and preferably from about 1 to about 20 centipoise, and a resistivity equal to or greater than, for example, $5\times10^9$ ohm/cm, such as $5\times10^{13}$. Preferably, the liquid selected is a branched chain aliphatic hydrocarbon. A nonpolar liquid of the ISOPAR® series (manufactured by the Exxon Corporation) may also be used for the developers of the present invention. These hydrocarbon liquids are considered narrow portions of isoparaffinic hydrocarbon fractions with extremely high levels of purity. For example, the boiling range of ISOPAR G® is between about 157° C. and about 176° C.; ISOPAR H® is between about 176° C. and about 191° C.; ISOPAR K® is between about 177° C. and about 197°C.; ISOPAR L® is between about 188° C. and about 206° C.; ISOPAR M® is between about 207° C. and about 254° C.; and ISOPAR V® is between about 254.4° C. and about 329.4° C. ISOPAR L® has a mid-boiling point of approximately 194° C. ISOPAR M® has an auto ignition temperature of 338° C. ISOPAR G® has a flash point of 40° C. as determined by the tag closed cup method; ISOPAR H® has a flash point of 53° C. as determined by the ASTM D-56 method; ISOPAR L® has a flash point of 61° C. as determined by the ASTM D-56 method; and ISOPAR M® has a flash point of 80° C. as determined by the ASTM D-56 method. The liquids selected are generally known and should have an electrical volume resistivity in excess of $10^9$ ohm-centimeters and a dielectric constant below 3 in embodiments of the present invention. Moreover, the vapor pressure at 25° C. should be less than 10 Torr in embodiments.

While the ISOPAR® series liquids can be the preferred nonpolar liquids for use as dispersant in the liquid developers of the present invention, the essential characteristics of viscosity and resistivity may be satisfied with other suitable liquids. Specifically, the NORPAR® series available from Exxon Corporation, the SOLTROL® series available from the Phillips Petroleum Company, and the SHELLSOL® series available from the Shell Oil Company can be selected.

The amount of the liquid employed in the developer of the present invention is, for example, from about 80 to about 99 percent, and preferably from about 85 to about 95 percent by weight of the total liquid developer. The term dispersion is used to refer to the complete process of incorporating a fine particle into a liquid medium such that the final product consists of fine toner particles distributed throughout the medium. Since liquid developer consists of fine particles dispersed in a nonpolar liquid, it is often referred to as dispersion. The liquid developer dispersion consists of fine toner particles, here referred to as toner solids, and nonpolar liquid. However, other effective amounts may be selected. The total solids which include resin, other charge additives such as adjuvants, optional colorants, and the cyclodextrin or aluminum complex charge acceptance agent, content of the developer in embodiments is, for example, 0.1 to 20 percent by weight, preferably from about 3 to about 17 percent, and more preferably, from about 5 to about 15 percent by weight.

Typical suitable thermoplastic toner resins can be selected for the liquid developers of the present invention in effective amounts, for example in the range of about 99.9 percent to about 40 percent, and preferably 80 percent to 50 percent of developer solids comprised of thermoplastic resin, charge acceptance component, and charge additive, and in embodiments other components that may comprise the toner. Generally, developer solids include the thermoplastic resin, charge additive, and charge acceptance agent. Examples of resins include ethylene vinyl acetate (EVA) copolymers (ELVAX® resins, E. I. DuPont de Nemours and Company, Wilmington, Del.); copolymers of ethylene and an alpha, beta-ethylenically unsaturated acid selected from the group consisting of acrylic acid and methacrylic acid; copolymers of ethylene (80 to 99.9 percent), acrylic or methacrylic acid (20 to 0.1 percent)/alkyl (C1 to C5) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company); or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E. I. DuPont de Nemours and Company); or blends thereof.

The liquid developers of the present invention can contain a colorant, for example, dispersed in the resin particles. Colorants, such as pigments or dyes and mixtures thereof, may be present to render the latent image visible.

The colorant, when present, may be contained in the developer in an effective amount of, for example, from about 0.1 to about 60 percent, and preferably from about 15 to about 60, and in embodiments about 25 to about 45 percent by weight based on the total weight of solids contained in the developer. The amount of colorant used may vary depending on the use of the developer. Examples of colorants, which may be selected, include carbon blacks available from, for example, Cabot Corporation, FANAL PINK™, PV FAST BLUE™, the colorants as illustrated in U.S. Pat. No. 5,223,368, the disclosure of which is totally incorporated herein by reference; other known colorants; and the like. Dyes are known and include food dyes.

To further increase the toner particle charge and, accordingly, increase the transfer latitude of the toner particles, charge adjuvants can be added to the developer. For example, adjuvants, such as metallic soaps like magnesium stearate or magnesium octoate can be added to the developer. These adjuvants may assist in enabling improved toner charging characteristics, namely, an increase in particle charge that results in improved image development and transfer to allow superior image quality with improved solid area coverage and resolution in embodiments. The adjuvants can be added to the developer in an amount of from about 0.1 percent to about 15 percent of the total developer solids, and preferably from about 3 percent to about 7 percent of the total weight percent of solids contained in the developer.

The liquid developer of the present invention can be prepared by a variety of processes such as, for example, mixing in a nonpolar liquid, thermoplastic resin, charge acceptance component, other charge additives, such as charge adjuvants, and optional colorant in a manner that the resulting mixture contains, for example, about 30 to about 60 percent by weight of solids; heating the mixture to a temperature of from about 40° C. to about 110° C. until a uniform dispersion is formed; adding an additional amount of nonpolar liquid sufficient to decrease the total solids concentration of the developer to about 10 to about 30 percent by weight solids and isolating the developer by, for example, cooling the dispersion to about 10° C. to about 30°C. In the initial mixture, the resin, charge acceptance component, colorant and charge acceptance additive may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, ceramic, zirconia, and the like. Carbon steel particulate media are particularly useful when colorants other than black are used. A typical diameter range for the particulate media is in the range of 0.04 to 0.5 inch (approximately 1 to approximately 13 millimeters).

Sufficient nonpolar liquid is added to provide a dispersion of from about 30 to about 60, and more specifically, from about 35 to about 45 percent solids. This mixture is then subjected to elevated temperatures during the initial mixing procedure to plasticize and soften the resin. The mixture is sufficiently heated to provide a uniform dispersion of the solid materials of, for example, colorant, when present, charge acceptance component, charge acceptance agent, and resin. However, the temperature at which this is undertaken should not be so high as to degrade the nonpolar liquid or decompose the resin or colorant if present. Accordingly, the mixture in embodiments is heated to a temperature of from about 50° C. to about 110°C., and preferably from about 50° C. to about 80° C. Thereafter, the resulting mixture may be ground in a heated ball mill or heated attritor at this temperature for about 15 minutes to 5 hours, and preferably about 60 to about 180 minutes. After grinding at the above temperatures, an additional amount of nonpolar liquid may be added to the dispersion. The amount of nonpolar liquid to be added should be sufficient in embodiments to decrease the total solids concentration of the dispersion to about 10 to about 30 percent by weight.

The dispersion is then cooled to about 10° C. to about 30°C., and preferably to about 15° C. to about 25°C., while mixing is continued until the resin admixture solidifies or hardens. Upon cooling, the resin admixture precipitates out of the dispersant liquid. Cooling can be accomplished by known means, such as a cooling fluid like water, glycols such as ethylene glycol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to about 36 hours, and preferably from about 2 to about 4 hours. Additional liquid may be added at any time during the preparation of the liquid developer to facilitate grinding or to dilute the developer to the appropriate percent solids. Other processes of preparation are generally illustrated in U.S. Pat. Nos. 4,760,009; 5,017,451; 4,923,778; 4,783,389, the disclosures of which are totally incorporated herein by reference.

As illustrated herein, the developers or inks of the present invention can be selected for RCP imaging and printing methods wherein, for example, there can be selected an imaging apparatus, wherein an electrostatic latent image, including image and nonimage areas, is formed in a layer of marking material, and further wherein the latent image can be developed by selectively separating portions of the latent image bearing layer of the marking material such that the image areas reside on a first surface and the nonimage areas reside on a second surface. In a simple embodiment, the invention can be defined as an image development apparatus comprising a system for generating a first electrostatic latent image on an imaging member, wherein the electrostatic latent image includes image and nonimage areas having distinguishable charge potentials, and a system for generating a second electrostatic latent image on a layer of marking materials situated adjacent the first electrostatic latent image on the imaging member, wherein the second electrostatic latent image includes image and nonimage areas having distinguishable charge potentials of a polarity opposite to the charge potentials of the charged image and nonimage areas in the first electrostatic latent image.

Embodiments of the invention will be illustrated in the following nonlimiting Examples, it being understood that these Examples are intended to be illustrative only, and that the invention is not intended to be limited to the materials, conditions, process parameters and the like recited. The toner particles in the liquid developer can range in diameter size of from about 0.1 to about 3 micrometers with a preferred particle size being 0.5 to 1.5 micrometers. Particle size, when measured, was measured by a Horiba CAPA-700 centrifugal automatic particle analyzer manufactured by Horiba Instruments, Inc., Irvine, Calif.

EXAMPLES

Control in Table 1=100 Percent of DuPont RX-76®; No Charge Acceptance Agent

Two hundred seventy (270) grams of NUCREL RX-76® (a copolymer of ethylene and methacrylic acid with a melt index of about 800, available from E. I. DuPont de Nemours & Company, Wilmington, Del.), and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to about 80° C. to about 115° C. for 2 hours. 675 Grams of ISOPAR-M® were added to the attritor at the conclusion of 2 hours, and cooled to 23° C. by running water through the attritor jacket, and the contents of the attritor were ground for an additional 4 hours. Additional ISOPAR-M®, about 900 grams, was added and the mixture was separated from the steel balls.

The liquid developer solids contained 100 percent NUCREL RX-76® toner resin. The solids level was 10.067 percent and the ISOPAR M level was 89.933 percent of this liquid developer. This liquid developer was used as is.

Example I in Table 1=95 Percent of DuPont RX-76®; 5 Percent Calcium Silicate Charge Acceptance Agent Two hundred fifty six point five (256.5) grams of NUCREL RX-76® (a copolymer of ethylene and methacrylic acid with a melt index of about 800, available from E. I. DuPont de Nemours & Company, Wilmington, Del.), 13.5 grams of the filler calcium silicate (available from Aldrich Chemicals) and 405 grams of ISOPAR-M® (Exxon Corporation) were added to a Union Process 1S attritor (Union Process Company, Akron, Ohio) charged with 0.1857 inch (4.76 millimeters) diameter carbon steel balls. The mixture was milled in the attritor, which was heated with running steam through the attritor jacket to 80° C. to 115° C. for 2 hours. 675 Grams of ISOPAR-M® were then added to the attritor at the conclusion of 2 hours, and cooled to 23° C. by running water through the attritor jacket, and the contents of the attritor were ground for an additional 4 hours. Additional ISOPAR-M®, about 900 grams, was added and the mixture was separated from the steel balls.

The resulting liquid developer solids contained 95 percent NUCREL RX-76® toner resin and 5 percent calcium silicate charge acceptance agent. The solids level was 10.184 percent and the ISOPAR M® level ws 89.814 percent for this liquid developer. The liquid developer was used as is in Example III.

Example II

Charging Voltage Test Results

To further evaluate and more fully understand the effect of the charge acceptor on RCP ink charging a toner layer surface-charging voltage test was employed, as illustrated, for example, in copending application U.S. Ser. No. 09/777,967, the disclosure of which is totally incorporated herein by reference.

TABLE 1

| | Ink Composition | | | | | Test Results* | | | |
|---|---|---|---|---|---|---|---|---|---|
| | | | | | | Positive Charging | | Negative Charging | |
| | Solid Phase | | | Liquid Phase | | | | | |
| | Resin | Pigment | Charge Acceptance Agent | Carrier fluid | Charge director | Initial Surface Voltage | Surface Voltage after 5 seconds | Initial Surface Voltage | Surface Voltage after 5 seconds |
| Control | 100% Nucrel RX-76 | No | No | Isopar M | No | 91 | 54 | −49 | −24 |
| Example 1 | 95% Nucrel RX-76 | No | 5% Calcium Silicate | Isopar M | No | 236 | 197 | −276 | −264 |

*All tests were carried out using +250 V and −250 V scorotron grid voltages for + and − charging, respectively.

Ink (toner) layers with thickness of about 15 $\mu$m were generated by draw bar coating. Scorotrons were used as charging and recharging devices.

The positive and negative toner layer charge-capturing propensity can be measured by several techniques. One frequently used technique involves first charging the toner layer with a scorotron for a fixed time, e.g. 2 seconds, and then monitoring the surface voltage decay as a function of time as soon as charging is turned off. This is accomplished for both positively and negatively charged toner layers.

The data for the Control of Table 1 indicates that the ink layer with no charge acceptor captured or accepted negative charge equivalent to a surface voltage of −49 volts and decayed to −24 volts thereof for 5 seconds. However, the same ink layer, when charged positively, captured or accepted +91 volts initially, but then the voltage of this control ink layer decayed to +54 volts in 5 seconds.

The data in Example I of Table 1, wherein 5 weight percent of calcium silicate was used as the charge acceptance agent, indicates that the ink layer, when charged negatively, captured or accepted negative charge equivalent to a surface voltage of −276 volts and maintained −264 volts thereof for 5 seconds. When charged positively, the same ink layer captured or accepted +236 volts and decayed slowly to +197 volts in 5 seconds. When charged negatively, the ink layer containing the 5 weight percent calcium silicate charge acceptance agent improved (versus the control without calcium silicate) in negative charging level from −49 volts to −276 volts (563 percent improvement). Comparing the decay for the 5 second negative surface voltage in Example I versus the Control indicates that in Example I the 5 second negative surface voltage was −264 volts (1,100 percent improvement) whereas in the Control the 5 second negative surface voltage was −24 volts. When charged positively, the ink layer containing the 5 weight percent calcium silicate charge acceptance agent showed similar positive charging level for both the Control without and the sample with 5 percent calcium silicate. When charged positively, the ink layer containing the 5 weight percent calcium silicate charge acceptance agent improved in positive charging level from +91 volts to +236 volts (259 percent improvement). Comparing the decay for the 5 second positive surface voltage in Example I versus the Control indicates that in Example I the 5 second positive surface voltage was +197 volts (365 percent improvement) whereas in the Control the 5 second positive surface voltage was only +54 volts.

Other embodiments and modifications of the present invention may occur to those skilled in the art subsequent to a review of the information presented herein; these embodiments and modifications, as well as equivalents thereof, are also included within the scope of this invention.

What is claimed is:

1. A liquid developer comprised of a nonpolar liquid, thermoplastic resin, optional colorant, and an inorganic filler, and wherein said inorganic filler functions as a charge acceptance additive, and which charge acceptance additive captures positive charges or negative charges to enable a positively charged developer or a negatively charged developer.

2. A developer in accordance with claim 1 wherein said inorganic filler is a silicate, kaolin, a silicate layer, a silica sheet, mica, a zeolite, or mixtures thereof, and wherein said inorganic filler contains a positive metal ion and which metal ion captures negative ions from a corona effluent by forming a covalent or coordinated covalent bond with said negative ions.

3. A developer in accordance with claim 1 wherein said filler is selected from the group consisting of silicates, kaolins, silicate layers, silica sheets, micas and zeolites.

4. A developer in accordance with claim 1 wherein said filler is a silicate of the formula $M_3^{II}M_2^{III}(SiO_4)$, where $M^{II}$ is $Ca^{+2}$, $Mg^{+2}$, or $Fe^{+2}$, and $M^{III}$ is $Al^{+3}$, $Cr^{+3}$, or $Fe^{+3}$; silicates containing the disilicate anion $Si_2O_7^{-6}$: $Sc_2Si_2O_7$ or $Zn_4(OH)_2Si_2O_7$; silicates containing infinite chains of the formula Mg $SiO_3$, Ca $SiO_3$ or $CaMg(SiO_3)_2$; or silicates containing layer or sheet-like structures with an empirical formula $(Si_2O_5)_n^{-2n}$; kaolin, $Al_2(OH)_4Si_2O_5$; talc, $Mg_3(OH)_2(Si_2O_5)_2$; micas, or $K(Mg,Fe)_3(AlSi_3O_{10})$.

5. A liquid developer in accordance with claim 1 wherein said inorganic filler possesses a particle size of from about 1 nanometer to about 100 nanometers.

6. A developer in accordance with claim 1 wherein the colorant is present in an amount of from about 1 to about 60 percent by weight based on the total weight of the developer solids.

7. A developer in accordance with claim 1 wherein the colorant is carbon black, cyan, magenta, yellow, blue, green, orange, red, violet and brown, or mixtures thereof.

8. A developer in accordance with claim 1 wherein the filler is present in an amount of from about 0.05 to about 10 weight percent based on the weight of the developer solids of resin, colorant, and filler.

9. A developer in accordance with claim 1 wherein the inorganic filler is a zeolite of the formula $M_{x/n}^{+n}[Al_xSi_yO_{2x+2y}]^{-x}zH_2O$ wherein x and n represent the valences of the respective species, M is a metal, and z represents the number of water molecules.

10. A developer in accordance with claim 1 wherein the inorganic filler possesses a high dielectric constant of from about 3.5 to about 1,000.

11. A developer in accordance with claim 1 wherein the liquid for said developer is an aliphatic hydrocarbon.

12. A developer in accordance with claim 11 wherein the aliphatic hydrocarbon is a mixture of branched hydrocarbons of from about 8 to about 16 carbon atoms, or a mixture of normal hydrocarbons of from about 8 to about 16 carbon atoms.

13. A developer in accordance with claim 1 wherein the resin is an alkylene polymer, a styrene polymer, an acrylate polymer, a polyester, mixtures thereof or copolymers thereof, wherein the resin is poly(ethylene-co-vinylacetate), poly(ethylene-co-methacrylic acid), poly(ethylene-co-acrylic acid), or poly(propoxylated bisphenol) fumarate, or wherein the resin is selected from the group consisting of alpha-olefin/vinyl alkanoate copolymers, alpha-olefin/acrylic acid copolymers, alpha-olefin/methacrylic acid copolymers, alpha-olefin/acrylate ester copolymers, alpha-olefin/methacrylate ester copolymers, copolymers of styrene/n-butyl acrylate or methacrylate/acrylic or methacrylic acid, and unsaturated ethoxylated and propoxylated bisphenol A polyesters.

14. A developer in accordance with claim 1 wherein the developer further contains a charge additive comprised of a mixture of I. a nonpolar liquid soluble organic aluminum complex that has been rendered insoluble by chemical bonding to the toner resin or by adsorption to the toner particles II. a nonpolar liquid soluble organic phosphate mono and diester mixture derived from phosphoric acid and isotridecyl alcohol that has been rendered insoluble by bonding to the insoluble organic aluminum complex and, or mixtures thereof of the formulas

I

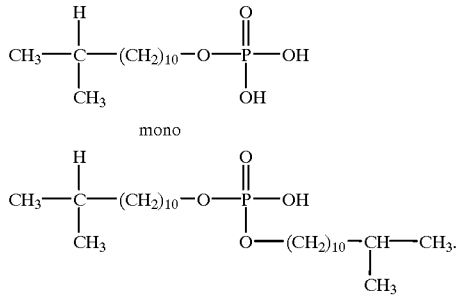

mono di

II

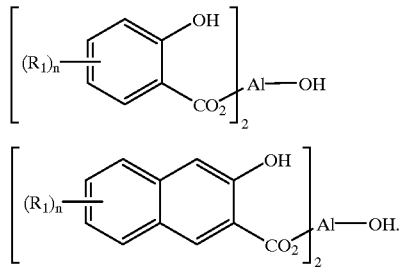

wherein $R_1$ is selected from the group consisting of hydrogen and alkyl, and n represents a number.

15. A developer in accordance with claim 1 wherein said developer further includes a charge adjuvant.

16. A positively or negatively charged substantially clear liquid developer comprised of a nonpolar liquid, resin, and a charge acceptance agent comprised of an inorganic filler, and wherein said inorganic filler contains a metal ion.

17. A developer in accordance with claim 16 wherein said inorganic filler is a silicate, kaolin, a silicate layer, a silica sheet, mica, a zeolite, or mixtures thereof, and which filler functions as a charge acceptance additive.

18. A developer in accordance with claim 16 wherein the inorganic filler is a zeolite.

19. A developer in accordance with claim 16 wherein the developer possesses a surface charging voltage of from about 75 volts to about 250 volts in both positive and negative polarities, and which surface charging voltage after ion charging is measured by an electrostatic voltmeter.

20. A developer in accordance with claim 16 further containing a colorant.

21. A developer in accordance with claim 1 comprised of from about 1 to about 20 percent solids of from about 0 to about 60 weight percent colorant, from about 0.05 to about 10 weight percent charge acceptance additive, and from about 30 to about 99.95 weight percent resin, and wherein the developer also contains from about 80 to about 99 weight percent of a nonpolar liquid, or comprised of from about 5 to about 15 percent by weight of toner solids comprised of from about 15 to about 55 weight of colorant, from about 0.05 to about 7 percent by weight of charge acceptance additive, and from about 38 to about 85 percent by weight of resin, and wherein the developer further contains from about 85 to about 95 percent by weight of a nonpolar liquid.

22. A liquid developer in accordance with claim 1 wherein said liquid is a nonpolar liquid, and said filler is a zeolite.

23. A liquid developer in accordance with claim 1 wherein said liquid has a viscosity of from about 0.5 to about 500 centipoise and resistivity equal to or greater than about $5\times10^9$, and said resin is a thermoplastic resin with a volume average particle diameter of from about 0.1 to about 30 microns, and said colorant is present in an amount of from zero (0) to about 40 weight percent.

24. A liquid developer in accordance with claim 1 wherein said filler is a mica of the formula $K(Mg,Fe)_3(AlSi_3O_{10})$, or wherein said filler is a kaolin of the formula $Al_2(OH)_4Si_2O_5$, a silicate in the form of a layer with a range of from about 0.5 nanometer to about 100 nanometers, or a disk of silicate, and wherein said silicate possesses a thickness of from about 0.5 nanometer to about 100 nanometers with a diameter of the disk being from about 1 nanometer to about 100 nanometers.

25. A liquid developer in accordance with claim 1 wherein said filler is calcium silicate, $CaSiO_3$, $MgSiO_3$, $CaMg(SiO_3)_2$, $Ca_2Mg_5(OH)_2(Si_4O_{11})_2$, or $Ca_3Al_2(SiO_3)_3$.

26. A xerographic imaging apparatus comprising a charging component, an imaging member, a developer component, and a fusing component, and wherein said developer component contains the liquid developer of claim 1.

27. A liquid developer consisting essentially of a nonpolar liquid, thermoplastic resin, colorant, and as a charge acceptance component, an inorganic filler, and wherein said filler is a silicate of the formula $M_3^{II}M_2^{III}(SiO_4)$, where $M^{II}$ is $Ca^{+2}$, $Mg^{+2}$, or $Fe^{+2}$, and $M^{III}$ is $Al^{+3}$, $Cr^{+3}$, or $Fe^{+3}$, silicates containing the disilicate anion $Si_2O_7^{-6}$: $Sc_2Si_2O_7$ or $Zn_4(OH)_2Si_2O_7$; silicates containing infinite chains of the formula $Mg\ SiO_3$, $Ca\ SiO_3$ or $CaMg(SiO_3)_2$; or silicates containing layer or sheet-like structures with an empirical formula $(Si_2O_5)_n^{-2n}$; kaolin, $Al_2(OH)_4Si_2O_5$; talc, $Mg_3(OH)_2(Si_2O_5)_2$; micas, or $K(Mg,Fe)_3(AlSi_3O_{10})$.

* * * * *